US008105077B2

(12) United States Patent
Bannos et al.

(10) Patent No.: US 8,105,077 B2
(45) Date of Patent: Jan. 31, 2012

(54) INTEGRATED OPERATING AND CONTROL PACKAGE FOR A PRESSURIZED BURNER SYSTEM

(75) Inventors: Thomas S. Bannos, Berkeley Heights, NJ (US); Timothy M. O'Neal, Randolph, NJ (US)

(73) Assignee: Red-Ray Manufacturing, Co., Inc., Branchburg, NJ (US)

( * ) Notice: Subject to any disclaimer, the term of this patent is extended or adjusted under 35 U.S.C. 154(b) by 125 days.

(21) Appl. No.: 12/193,480

(22) Filed: Aug. 18, 2008

(65) Prior Publication Data

US 2009/0061373 A1 Mar. 5, 2009

Related U.S. Application Data

(60) Provisional application No. 60/956,513, filed on Aug. 17, 2007.

(51) Int. Cl.
*F23Q 9/08* (2006.01)

(52) U.S. Cl. ..... 431/281; 431/12; 431/354; 126/39 E

(58) Field of Classification Search ..... 431/202, 431/354, 12, 281; 126/39 E
See application file for complete search history.

(56) References Cited

U.S. PATENT DOCUMENTS 2,620,176 A * 12/1952 Gorman et al. ..... 432/32
2,805,653 A * 9/1957 Junkins ..... 122/479.1
2,819,702 A * 1/1958 Koch ..... 122/479.2
2,980,104 A * 4/1961 Patrick et al. ..... 126/271.2 R
3,092,169 A * 6/1963 Lohman ..... 431/191
3,101,897 A * 8/1963 Vaughn ..... 236/1 E
3,228,113 A * 1/1966 Fannon, Jr. ..... 34/308
3,447,745 A * 6/1969 Perrine et al. ..... 236/15 R
3,622,257 A * 11/1971 Hein et al. ..... 431/201
3,703,744 A * 11/1972 Dillon ..... 452/73
3,712,542 A * 1/1973 Price, Jr. ..... 239/2.1
3,823,704 A * 7/1974 Daugirda et al. ..... 122/18.4
4,059,386 A * 11/1977 Eising ..... 431/43
4,348,169 A * 9/1982 Swithenbank et al. ..... 431/89
4,390,125 A * 6/1983 Rozzi ..... 237/70
4,780,076 A * 10/1988 Davis ..... 431/1
4,834,644 A * 5/1989 Snow ..... 431/1
4,887,959 A * 12/1989 Shellenberger ..... 431/46
4,989,501 A * 2/1991 Catan ..... 454/188
5,190,452 A * 3/1993 Katchka et al. ..... 431/12
5,353,986 A * 10/1994 Wortman et al. ..... 237/2 R
5,553,391 A * 9/1996 Bakalar ..... 34/110
5,628,303 A * 5/1997 Ahmady et al. ..... 126/91 A
5,660,542 A * 8/1997 Rinker et al. ..... 432/19
5,685,707 A * 11/1997 Ramsdell et al. ..... 431/90
5,865,616 A * 2/1999 George ..... 431/284
5,931,652 A * 8/1999 Epworth ..... 431/3
5,966,835 A * 10/1999 Bakalar ..... 34/267

(Continued)

*Primary Examiner* — Kenneth Rinehart
*Assistant Examiner* — Jorge Pereiro
(74) *Attorney, Agent, or Firm* — Rudoler & DeRosa LLC

(57) ABSTRACT

An operating and control package for at least one pressurized burner. The operating and control package comprises a controller and a gas control device. The controller is an integrated packaged unit for supplying and controlling a pre-mixed air/gas pressurized burner. A housing is provided for containing the controller. The housing is preferably located at the end of the burner manifold. The gas control device comprises a gas control valve for receiving gas entering the control package and a premix blower located within the housing for receiving gas from the gas control valve and air entering the control package. The gas control device mixes the air and gas to form a pressurized combustible mixture which is fed into the burner.

18 Claims, 13 Drawing Sheets

U.S. PATENT DOCUMENTS 6,019,593 A * 2/2000 Lewandowski et al. ..... 431/12
6,172,666 B1 * 1/2001 Okura ..... 345/168
6,244,855 B1 * 6/2001 Turk et al. ..... 431/12
6,332,408 B2 * 12/2001 Howlett et al. ..... 110/189
6,464,000 B1 * 10/2002 Kloster ..... 165/247
6,505,099 B1 * 1/2003 Brice et al. ..... 700/277
6,560,893 B1 * 5/2003 Bakalar ..... 34/110
6,619,951 B2 * 9/2003 Bodnar et al. ..... 431/329
6,694,926 B2 * 2/2004 Baese et al. ..... 122/14.2
6,719,207 B2 * 4/2004 Kloster ..... 236/11
6,786,422 B1 * 9/2004 Wortman et al. ..... 237/70
6,968,851 B2 * 11/2005 Ramirez et al. ..... 137/1
6,971,871 B2 * 12/2005 Ahmady ..... 431/180
7,282,172 B2 * 10/2007 Hugens et al. ..... 266/197
7,506,617 B2 * 3/2009 Paine ..... 122/448.3
2002/0092482 A1 * 7/2002 Bodnar et al. ..... 122/15.1
2003/0005892 A1 * 1/2003 Baese et al. ..... 122/448.1
2003/0029924 A1 * 2/2003 Kloster ..... 236/11
2003/0091950 A1 * 5/2003 Pijper ..... 431/353
2004/0106078 A1 * 6/2004 Goebel ..... 431/12
2005/0175944 A1 * 8/2005 Ahmady ..... 431/18
2005/0227195 A1 * 10/2005 George ..... 431/352
2005/0266362 A1 * 12/2005 Stone et al. ..... 431/18
2005/0274328 A1 * 12/2005 Baese et al. ..... 122/14.1
2006/0169275 A1 * 8/2006 Murdoch ..... 126/91 A
2008/0035746 A1 * 2/2008 Willms ..... 237/2 A
2009/0180232 A1 * 7/2009 Brice et al. ..... 361/103
2010/0001087 A1 * 1/2010 Gum ..... 237/2 A

* cited by examiner

INTEGRATED OPERATING AND CONTROL PACKAGE FOR A PRESSURIZED BURNER SYSTEM

CROSS-REFERENCE TO RELATED APPLICATIONS

The present application claims the benefit of U.S. Provisional Application No. 60/956,513, filed on Aug. 17, 2007, which is incorporated herein by reference.

STATEMENT REGARDING FEDERALLY SPONSORED RESEARCH OR DEVELOPMENT

The present invention was not developed with the use of any Federal Funds, but was developed independently by the inventors.

BACKGROUND OF THE INVENTION

The invention relates to a controller for infrared (IR) premix burner arrays, ribbon burners, line burners, and the like, and in particular to a controller that allows an end user to run a burner or burner array without the normal costly auxiliary equipment required on larger systems, and yet remain compliant with all codes.

In the past if an end user wanted to run a small gas IR system the cost of the actual burner array would be in the range of about 20 percent of the total cost of the system when conforming to NFPA, FM, CSA and IRI code requirements. This would usually make the total price very unattractive, driving the customer away from using an IR system. This constraint often forces the customer to look at other types of heat sources like electric or convection heat which is much less costly to purchase for their process, but often more expensive to operate.

The present invention solves these problems of prior art controllers by providing a compact modular controller which is cost effective. In the present invention the cost of the IR burners remains the same, as in the above example, however the burner cost, in terms of the total system, would be up to 80 percent while the auxiliary equipment would drop to as low as about 20 percent of the total system. This makes the total system price very attractive and makes economically feasible all of the smaller systems that were too costly in the past driving the end user away from IR because of the high cost to purchase the compliant IR system.

Another advantage of the present invention is that the unit is nearly silent in operation compared to prior art combustion air blowers. The noise of these existing systems prevents them from being used in a store front or restaurant area. Prior to the present invention, stores and restaurants would use electric IR systems even though the cost of operation was higher.

SUMMARY OF THE INVENTION

The invention comprises an operating and control package for at least one pressurized burner. The operating and control package comprises a controller and a gas control device. The controller is an integrated packaged unit for supplying and controlling a pre-mixed air/gas pressurized burner. A housing is provided for containing the controller. The housing is preferably located at the end of the burner manifold. The gas control device comprises a gas control valve for receiving gas entering the control package and a premix blower located within the housing for receiving gas from the gas control valve and air entering the control package. The gas control device mixes the air and gas to form a pressurized combustible mixture which is fed into the burner.

The operating and control may include an air/gas control and safety system and an air intake filter, ignition and monitoring devices, indicator lights, and operating switches. The air/gas control and safety system may include a flame monitor and/or a blower pressure monitor. A bracket may be disposed around the inside or outside perimeter of the housing for mounting the device in various configurations.

An internal calibration may be provided for presetting the controller to match the maximum output of the pressurized burner being supplied and the type of fuel being utilized. An adjustment control may also be provided for use by a user for varying the air/gas input flow rate to the burner between a maximum and minimum output which may be pre-set to correspond to the specific burner requirements.

DETAILED DESCRIPTION OF THE INVENTION

Definitions

Figure 1:
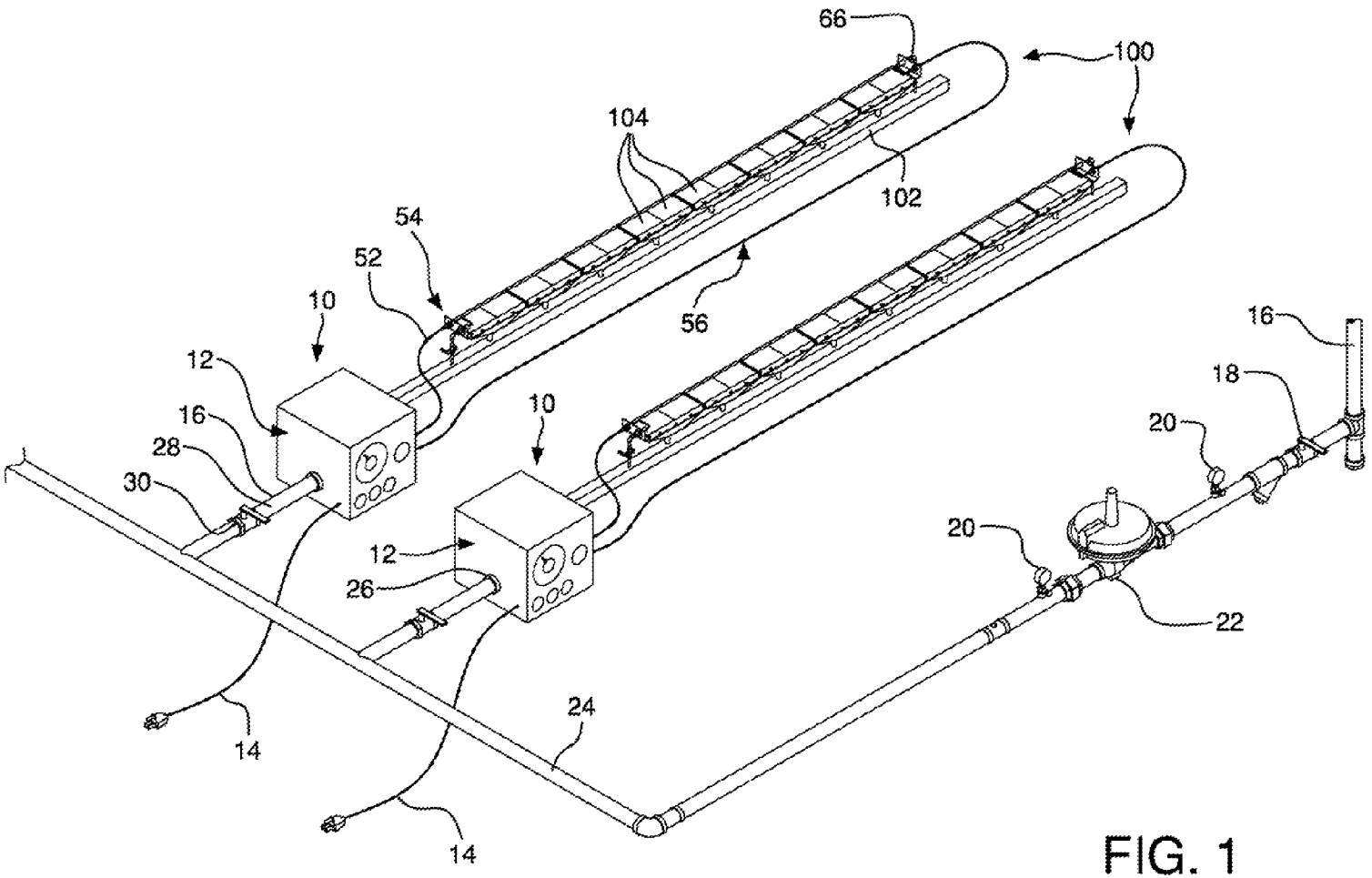
FIG. 1 is a schematic view of one embodiment of a burner system comprising an operating and control package in accordance with the present invention.

Definition 1: Premix Infrared (IR) Burner is a burner requiring a combustion air supply from either a combustion air blower or a compressor where the combustion takes place on an emitter surface causing the emitter to radiant energy directly to a substrate without heating all of the air molecules between the burner and the substrate, making the process very efficient.

Definition 2: Air/Gas Ratio Regulator is a device to ensure that the same ratio of gas to air is always the same regardless of the volume of air/gas mixture.

Definition 3: Small IR system 10,000 Btu/Hr-500,000 Btu/Hr

Definition 4: Aspirator Mixer is a device to mix an air/gas mixture on ratio (for example, 10 parts air/1 part natural gas) under a set static pressure to a burner array.

Referring now to FIGS. 1 through 5, the invention relates to an operating and control package 10 for at least one pressurized burner 100. Preferably, the controller 10 is an integrated packaged unit for supplying and controlling a pre-mixed air/gas pressurized burner 100. The present invention is an improved, more economical solution for supporting a pressurized burner than existing burner controllers.

Figure 3:
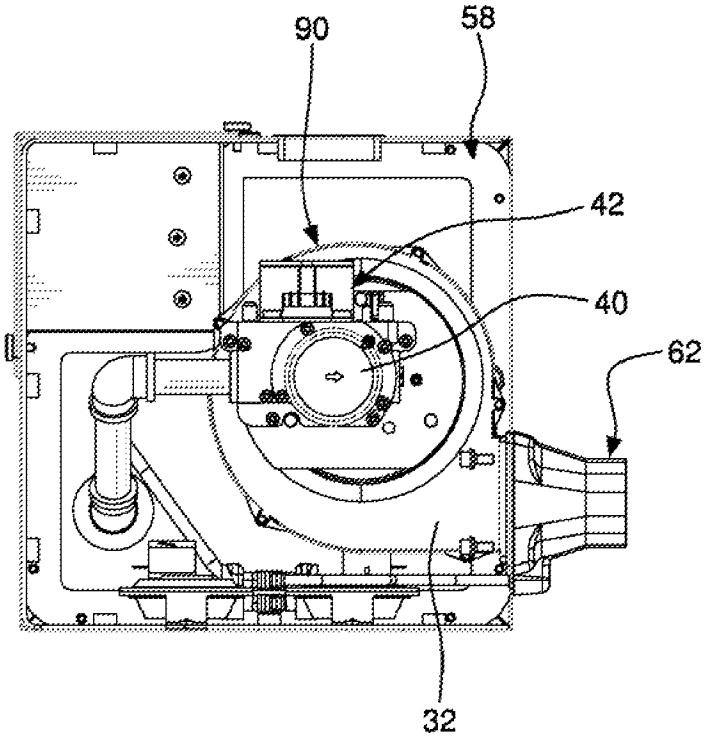
FIG. 3 is cross-sectional view of the operating and control package taken along line 3-3 of FIG. 2.

Referring now to FIG. 1, the controller 10 comprises a small housing 12 that preferably contains a premix gas blower 32 (as best seen in FIG. 3) and all the operating and control devices for the burner 100 in a neat and compact package. The housing 12 is preferably located at the end of the burner manifold 102 of the burner 100 which serves as a heat emitter. Typically, the burner 100 comprises the burner manifold 102 and one or more burner sections 104 which are mounted to the burner manifold 102.

An electrical power supply cord 14 is connected to the housing 12 for supplying power to the controller 10. A gas supply 16, such as natural gas or propane, supplies pressurized gas to the controller 10. The gas supply is a single fuel delivery system which includes a main shut of valve 18, pressure gauges 20, a gas pressure regulator 22, and a gas manifold 24 which supplies gas to the controllers 10 which then supplies a pressurized air/gas mixture to one or more burners 100. Each controller 10 has a gas inlet 26 which connects to an outlet 28 of the gas manifold 24. Each gas outlet 28 comprises a safety shut-off valve 30 for stopping the flow of gas to each controller 10 when the burner 100 is not in use.

The burner manifold 102 for each burner 100 is of conventional construction and is not limited in length or shape, and may be U-shaped, J-shaped, L-shaped, polygonal shaped and the like as is well known in the art.

Figure 4:
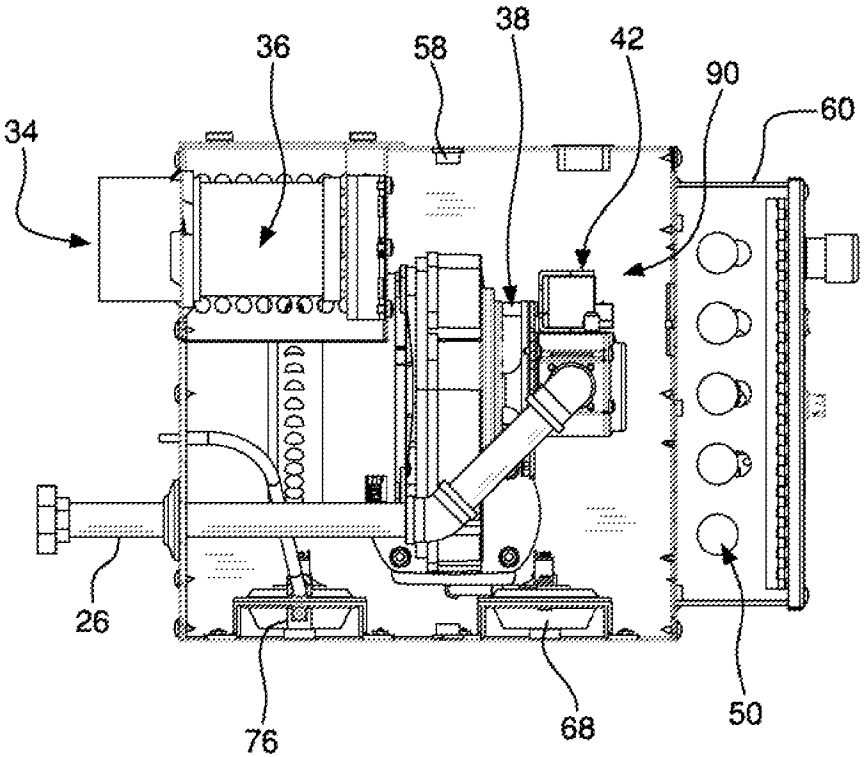
FIG. 4 is cross-sectional view of the operating and control package taken along line 4-4 of FIG. 2.

Referring now to FIGS. 3 and 4, a premix gas blower 32 is provided for mixing air and gas to form a combustible mixture for feeding into the burner 100. Gas is fed to the gas inlet 40 of the blower 32 via the gas inlet 26 of the housing 12. Air is fed into the housing 12 via an air inlet 34. An air filter 36 filters the incoming air which enters the blower 32 through the blower air inlet 38. The blower 32 forces the air/gas mixture through a blower outlet 62 and into the burner manifold 102.

The gas control device 90 comprises a gas control valve 42 for receiving gas entering the control package 10. The gas control device 90 also includes the premix blower. The gas control device 90 mixes the air and gas to form a pressurized combustible mixture which is fed into the burner, as described in greater detail below.

The gas control device 90 is a fully integrated air/gas control device. The gas control device 90 also includes valves, a servo pressure regulator, and a strainer. The gas control device 90 is part of the safety system 64. The gas valve 42 includes a servo regulator for regulating the amount of gas to match the airflow through the gas valves. The gas valve 42 also includes a gas filter and a pressure regulator.

Referring now to FIG. 1, an igniter 54 is provided for igniting the air/gas mixture on the surface of the burner sections 104. The igniter 54 may be a pilot igniter (as shown) or may be any other suitable type of igniter known in the art.

Figure 5:
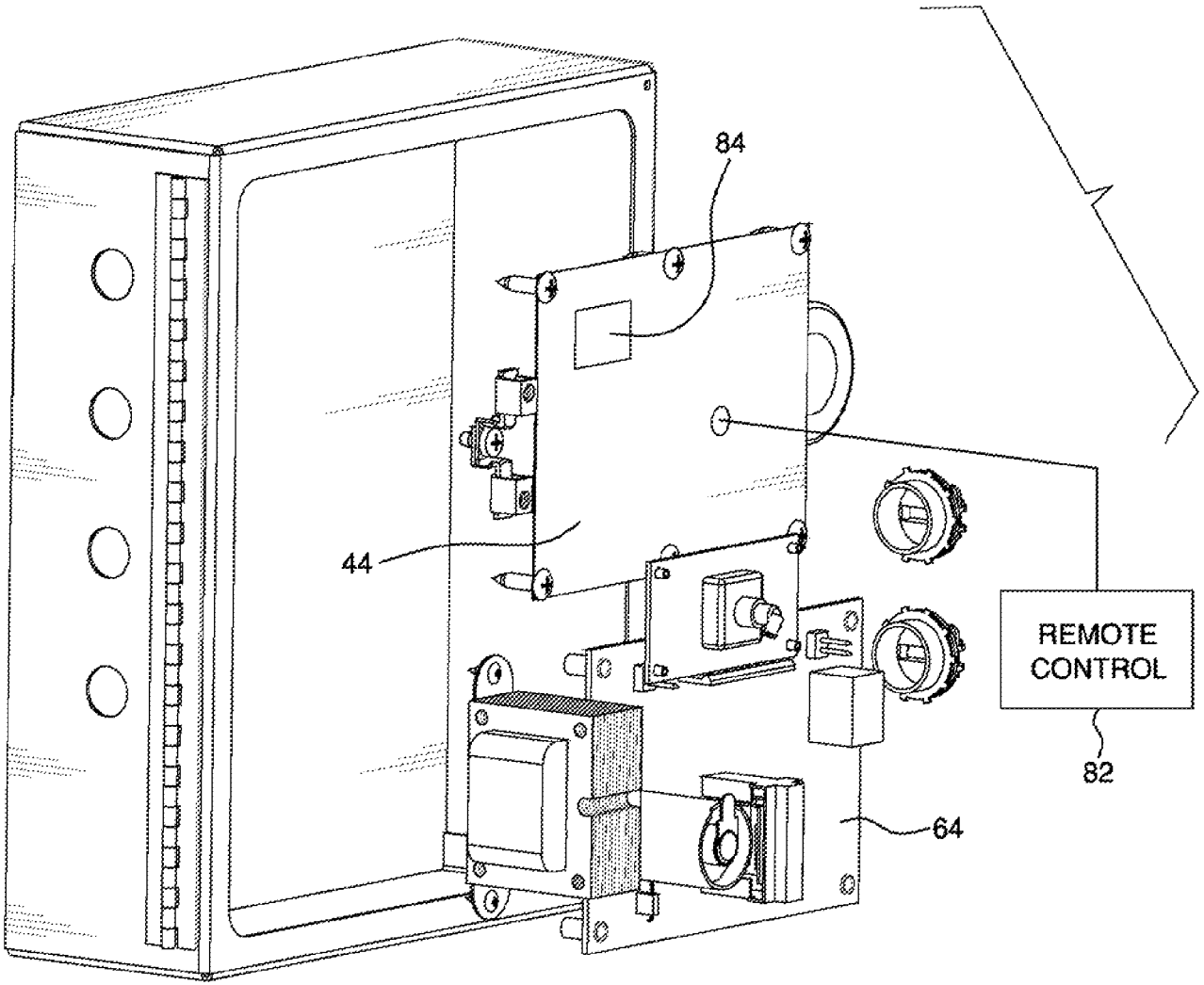
FIG. 5 is cross-sectional view of the operating and control package taken along line 5-5 of FIG. 2.

Referring now to FIGS. 1 and 5, in accordance with the invention, an air/gas control and safety system 64, which is part of the controller 44, is provided for shutting the gas valve 42 in the absence of a flame signal from the burner 100. The safety system 64 comprises a flame monitor 66 and a blower pressure monitor 68 for monitoring the burner.

The flame monitor 66 provides constant flame monitoring to detect the presence or absence of a flame. In the event that the flame is not detected, the controller 10 will shut the gas valve 42 to stop the flow of gas.

The blower pressure monitor 68 provides constant blower outlet monitoring for shutting the gas valve 42. Alternatively, the blower pressure monitor 68 may monitor the pressure at the burner manifold 102.

Optionally, a user interlock, such as a high temperature limit switch or a line stop switch, may be provided as an additional external safety device for shutting the gas valve 42.

The ignition wiring 52 is provided from the controller 10 for the spark igniter 54, best seen in FIG. 1. Flame monitoring wiring 56 is also provided for the flame monitor 66.

It should be understood that whenever one or more of the safety control systems 64 shuts the gas valve 42, the blower 32 remains on to purge the system for a selected period of time.

Figure 2:
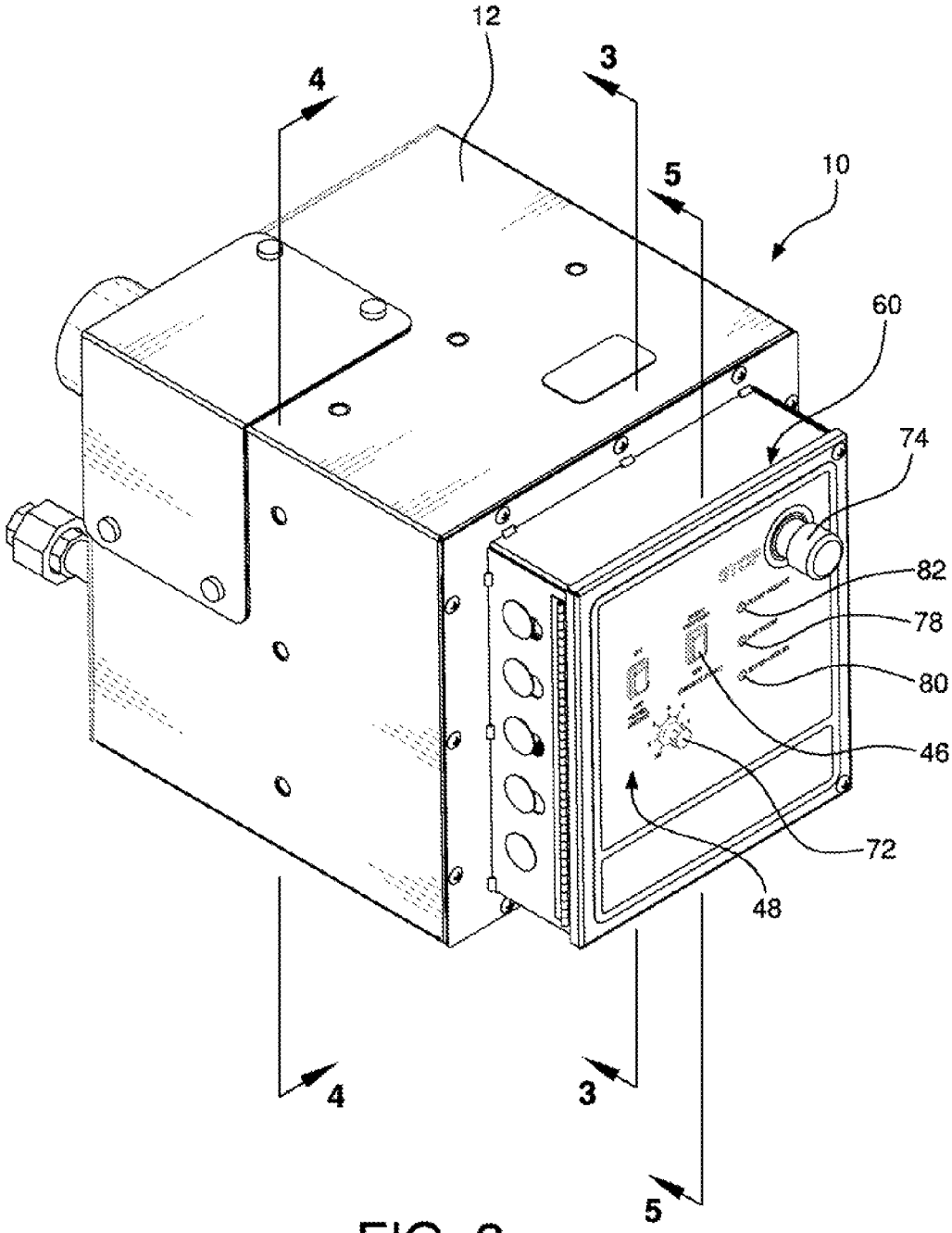
FIG. 2 is a schematic view of the operating and control package of the invention of FIG. 1.

As best seen in FIGS. 2 and 4, the controller system includes an operator control box 60 which comprises electronic control circuitry 44, indicator lights 46, and operating switches 48, as described in greater detail below. In addition, as best seen in FIGS. 3 and 4, a bracket 58 maybe provided which extends around the inside or outside perimeter of the housing for mounting the device in various configurations.

Preferably, the controller 10 includes an internal calibration so it can be pre-set, such as under factory conditions, to match the maximum output of the pressurized burner 100 being supplied and the type of fuel being utilized. The controller 10 comprises an adjustment control, such as a dial 72 located on the face of the operator control box 60 for use by the end user for varying the air/gas input flow rate to the burner, i.e., BTU/hr between a maximum and minimum output which may be pre-set to correspond to the specific burner requirements.

In operation, the volumetric output is relative to the downstream pressure build up and the blower speed. As such, a potentiometer controlled by the flow rate control dial 72, may be used to vary the speed of the blower 32. The controller may also include an emergency stop button 74 for shutting the gas valves and the blower after it has purged the system. Optionally, the controller 10 may include a remote start-stop capability and a remote modulation device 82, in lieu of the manually operated potentiometer associated with dial 72, as described above. The controller 10 may include any external controller which is capable of transmitting a suitable electronic signal to the controller 10. For example, a temperature controller having a 4 to 20 milliamp signal may be used as one suitable external controller.

Figure 6:
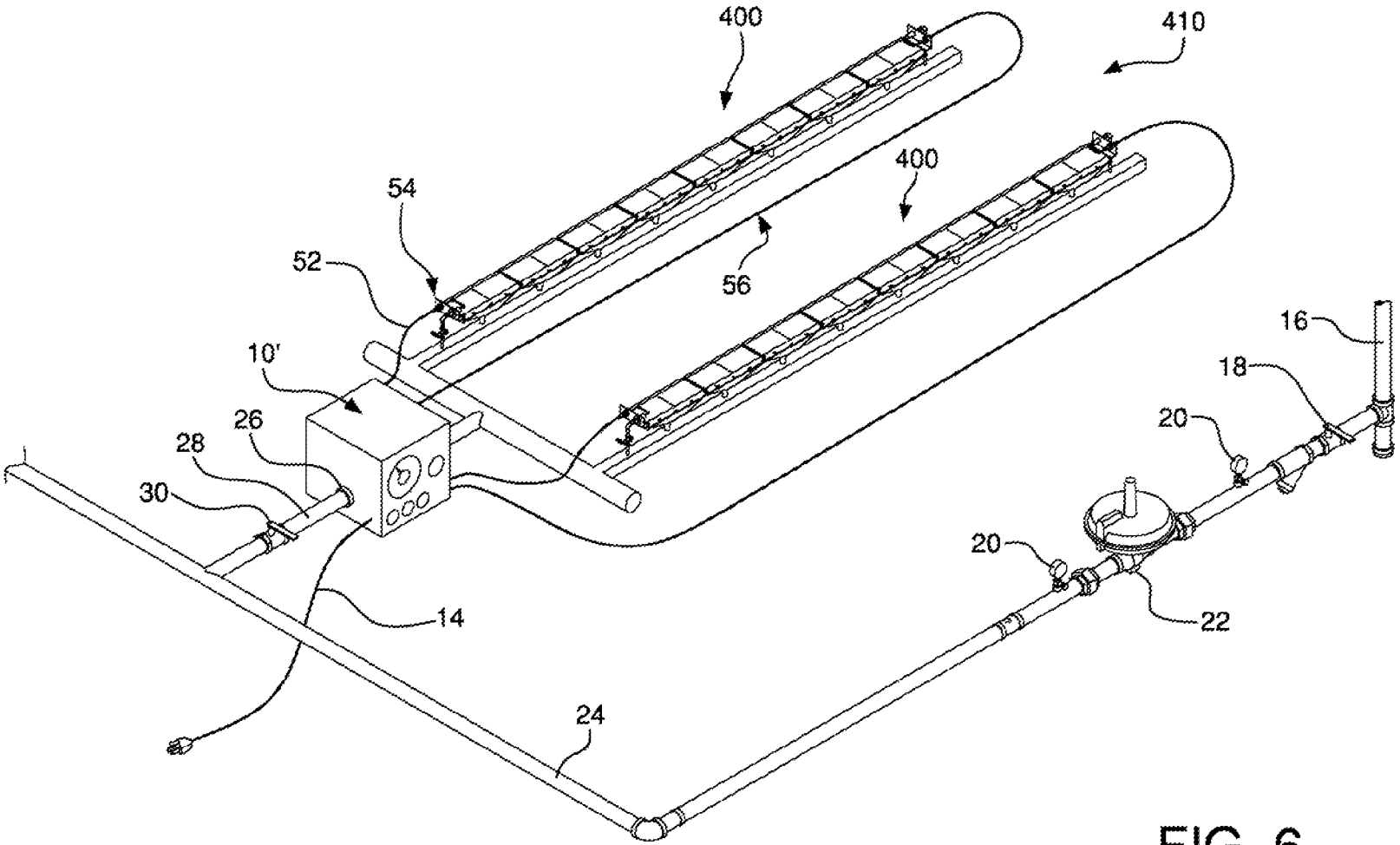
FIG. 6 is a schematic view of a small array of burners utilizing the invention of FIG. 1.
Figure 7:
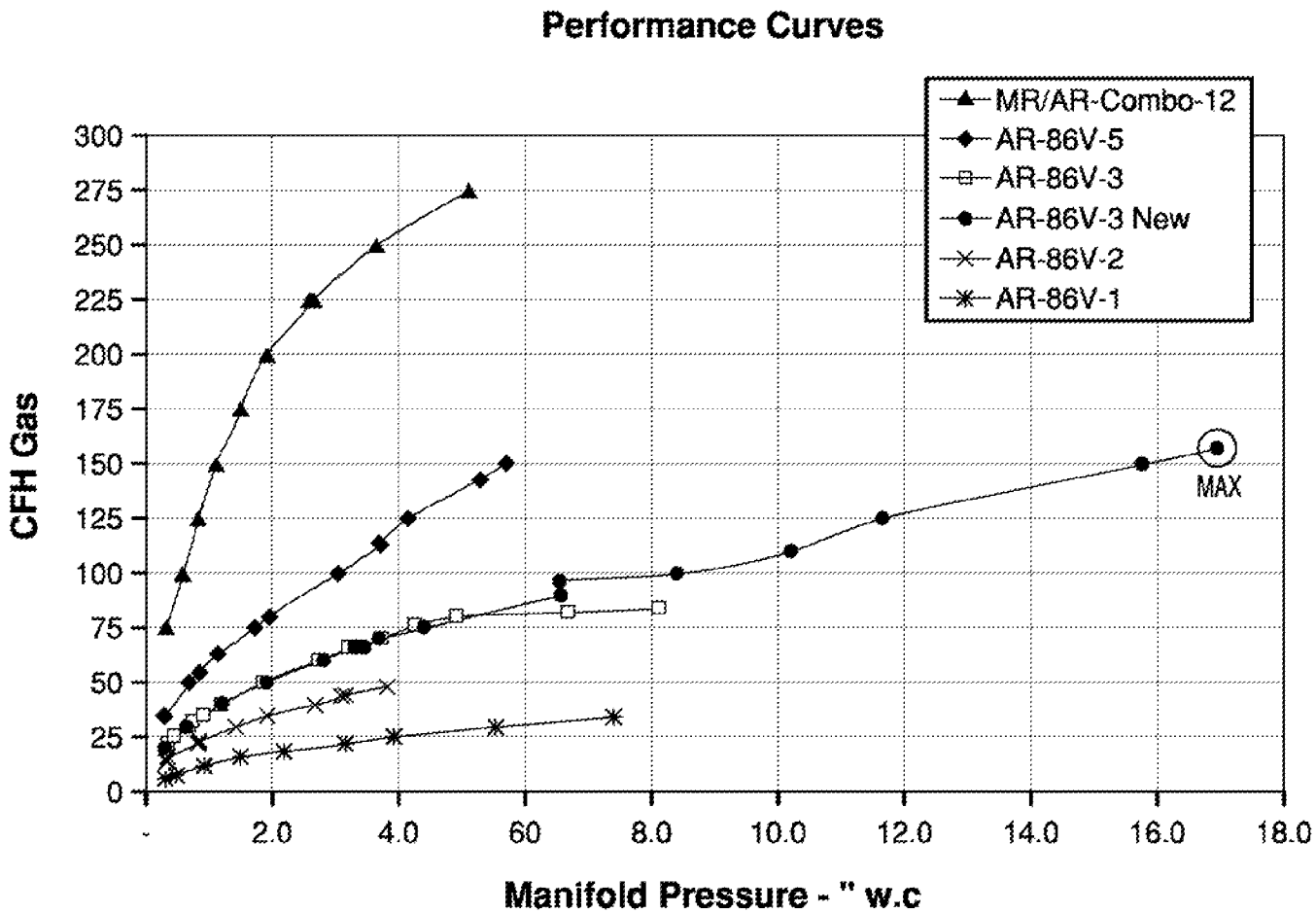
FIGS. 7-10 are performance graphs for the invention of FIG. 1.
Figure 8:
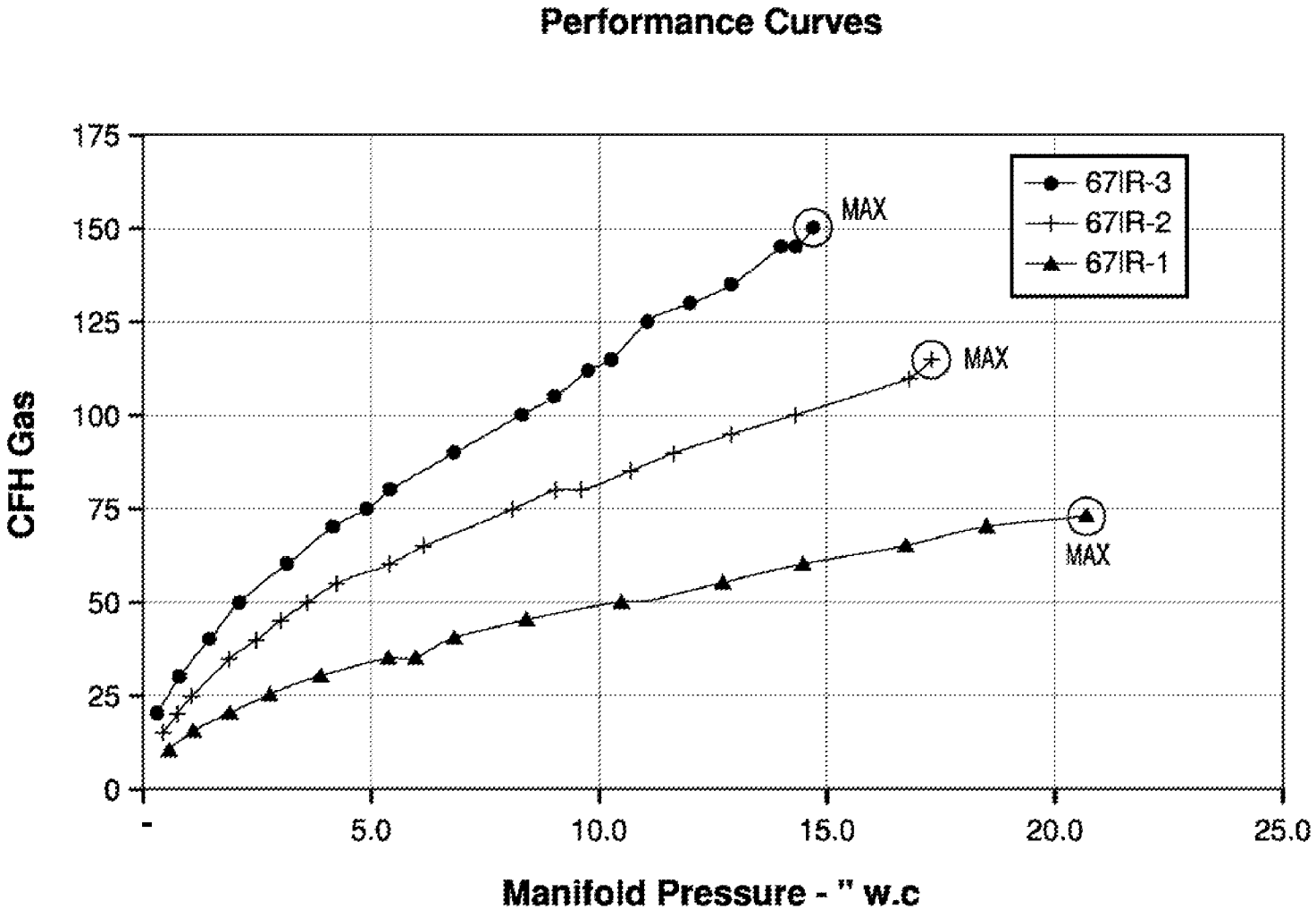
Figure 9:
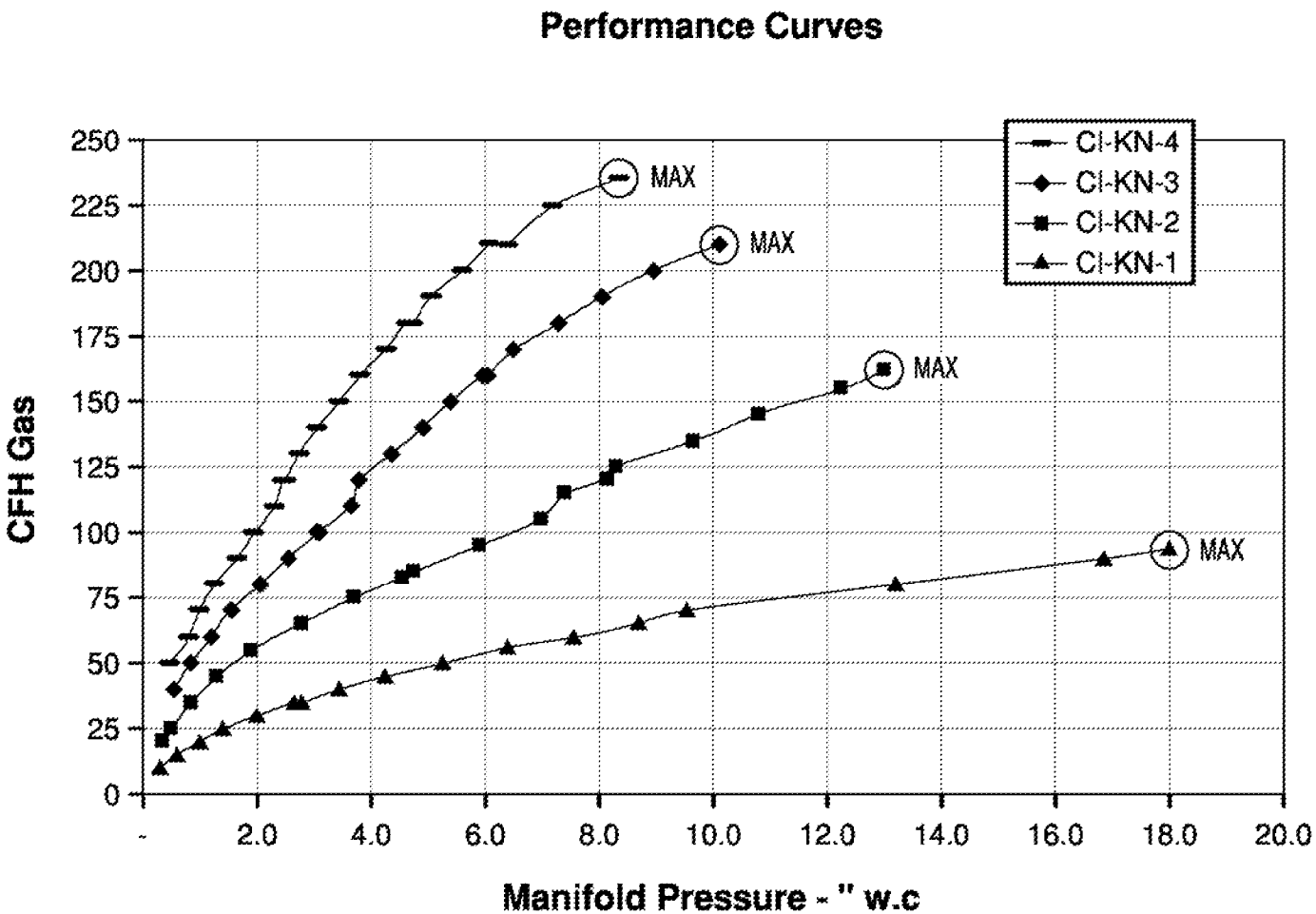
Figure 10:
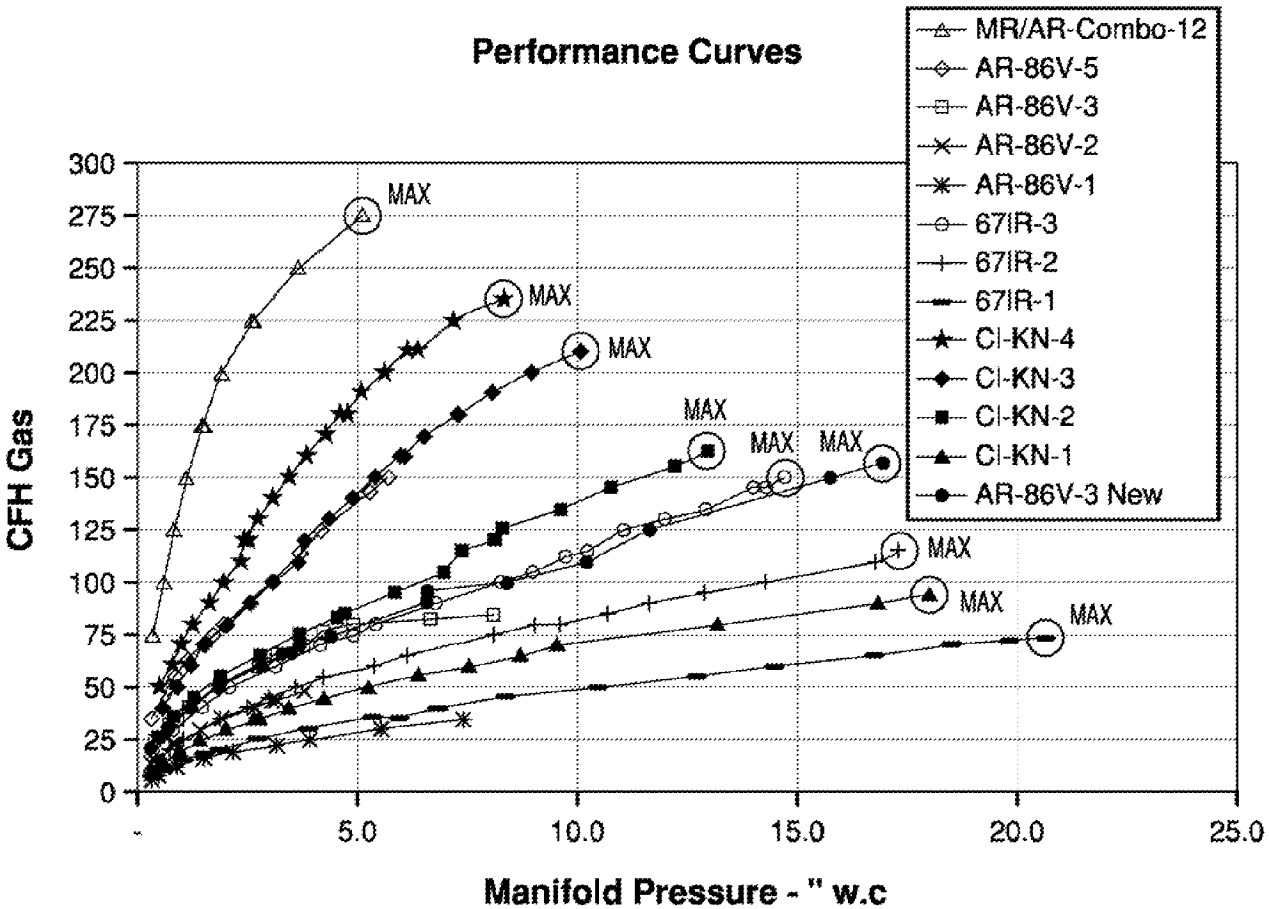

One advantage of the present invention is that systems having a single burner, as shown in FIG. 1, or a small set of burners, as shown in FIG. 6, are much less costly to implement than existing controller systems. Referring now to FIG. 6, in which like parts are referred to by like reference numerals, a control package 10' is shown which is similar to the control package described in connection with FIGS. 1-5. The control package 10' is in communication with a small set of burners 410 having a plurality of pressurized burners 400. The invention also provides flexibility for users to increase the capacity of their burner systems economically by adding additional rows of burners with their accompanying gas supply and control packages in incremental modular add-on units.

The invention is a compact design, in that the housing can be as small as one square foot in volume. The control package permits the ability to be pre-set to operate a variety of burners and burner sizes and maintain the air/gas ratio throughout. Referring now to FIGS. 7-10, performance curves are shown in which manifold pressure is plotted with respect to the volumetric flow rate of fuel gas for various sized blowers, as described in greater detail below.

Different types of burners require different head pressures in the manifold. One type may require only 3.5" w.c. pressure to operate at full fire, whereas another type will require 10" w.c. pressure to operate at full fire. The unit with one size blower can be set to run a small 6" by 8" sized 20,000 BTU/hr.

burner over its entire range while maintaining its air/gas ratio and then be reset to operate a much larger burner such as an 8 ft long by 6" burner with 264,000 BTU/hr. over its entire range while maintaining its air/gas ratio. A different unit with a larger blower size would operate the same way, although the range of the size burners would shift to a higher output amount. Thus, there would be some overlapping of the size range of burner that would operate from a smaller to a larger blower sized unit.

Another advantage of the present invention is the ability to maintain constant air-fuel ratio over its range of outputs. Another unique feature is that even though the air filter in the unit may clog over time, the unit will still operate, and maintain the air/gas ratio with this reduced air at a reduced output (BTU/hr.) as shown in FIGS. 7-10. Referring now to FIGS. 2 and 4, there is a pressure differential device 76 wired to the controller 44 which will energize an indicator light 78 on the face of the control panel 60 for notifying the user that the air filter 36 needs cleaning or changing. The control panel 60 also includes an indicator light 80 for notifying the user that the blower monitor 68 has detected a fault condition. Another indicator light 82 may be provided for notifying the user of a flame failure.

Optionally, the controller may be provided with an alarm relay 84 for notifying the user of various failure conditions.

Figure 11:
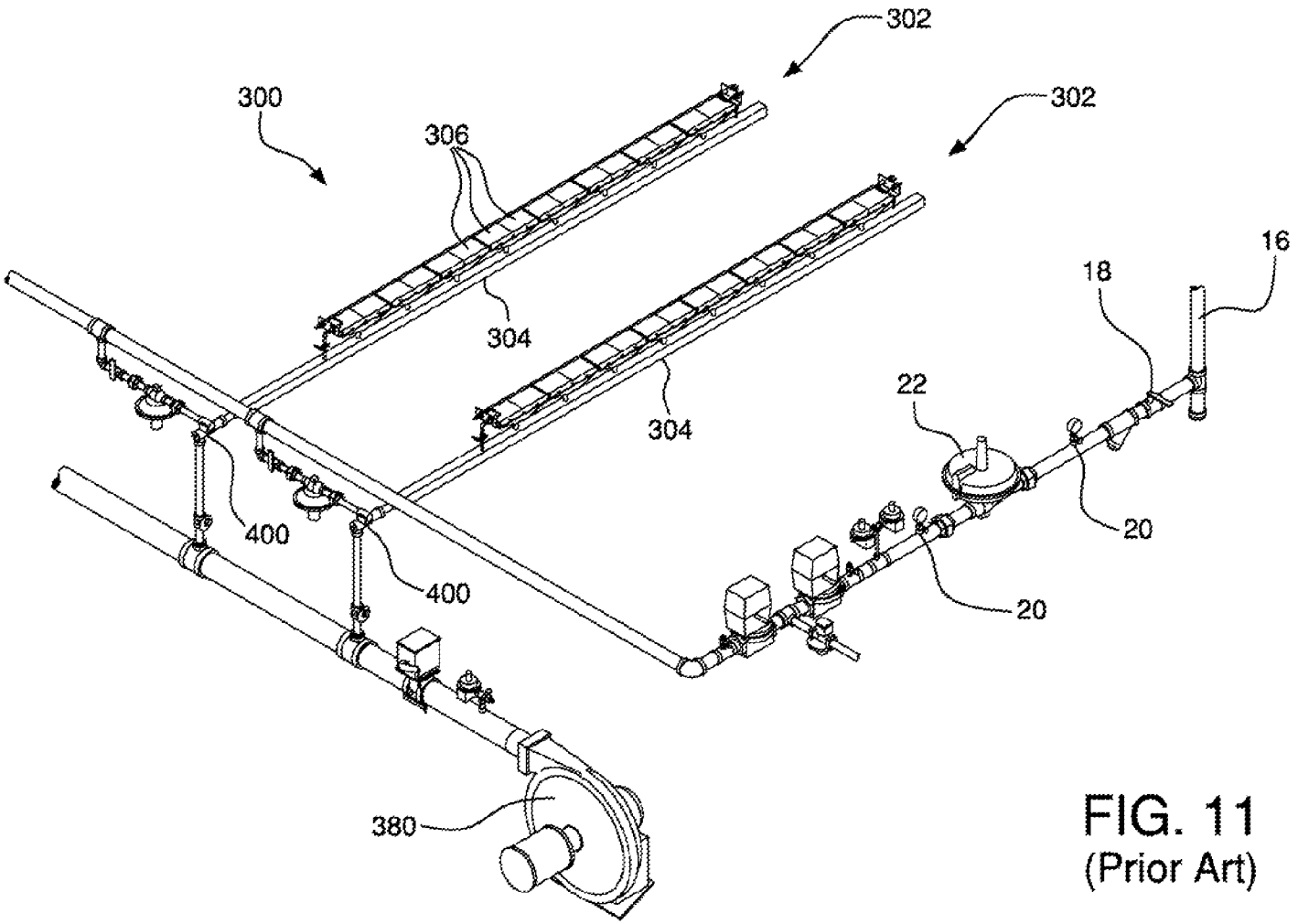
FIG. 11 (Prior Art)
FIG. 11 is a schematic view of a typical prior art pressurized burner system.

In FIG. 11 there is shown a typical prior art pressurized burner system 300. The burner system 300 is an infrared burner comprising one or more burner sections 306 connected to a common pipe or tube manifold 304. The manifold 304 serves as a plenum so it becomes pressurized to feed each burner section 306 with the same volume of pre-mixed air/gas from the air and gas supplies. A combustion air blower 380 is provided for pressurizing the burner system as is known in the art.

Another example of an existing pressurized burner is a line or ribbon flame burner (not shown). Such a burner comprises a tube or pipe having a plurality of small holes or ports formed along the length thereof. The burner operates by pressurizing the tube or pipe, for example, such that the air/gas mixture exits multiple small ports formed therein for combustion. Such an arrangement maintains a long flame down the length of the burner tube for process heating purposes, for example.

Figure 12:
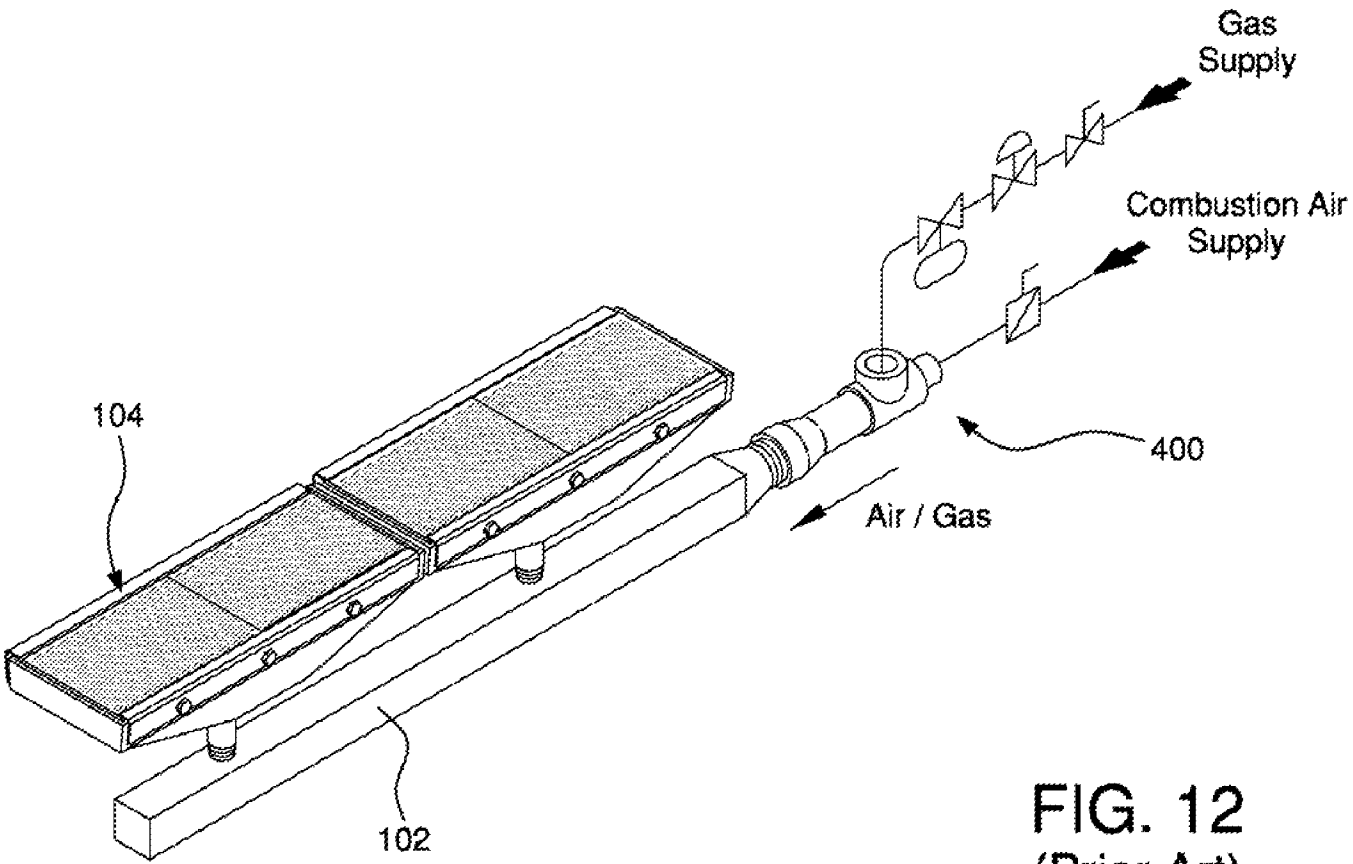
FIG. 12 (Prior Art)
FIG. 12 is a schematic view of a typical prior art pressurized burner system having a venturi mixer.

Existing combustion air blowers are typically used to provide combustion air to an air/gas mixing device, such as a venturi mixer 400, as shown in FIGS. 11 and 12. In such a system, the blower (not shown) is sized to the total flow rate (BTU/hr) requirement of the system. Each of the air/gas mixing devices, air flow valves and gas pressure regulators also need to be sized to match the flow rate (BTU/hr) requirements. An end user requiring only a single small infrared premix burner would have to spend up to five times as much for the support and control equipment than the burner itself. Another disadvantage of existing systems is that if the end user requires several rows of burners added, the additional BTU/hr requirement will typically exceed the capabilities of the original support equipment. Much of that equipment would then need to be replaced at great expense.

Figure 13:
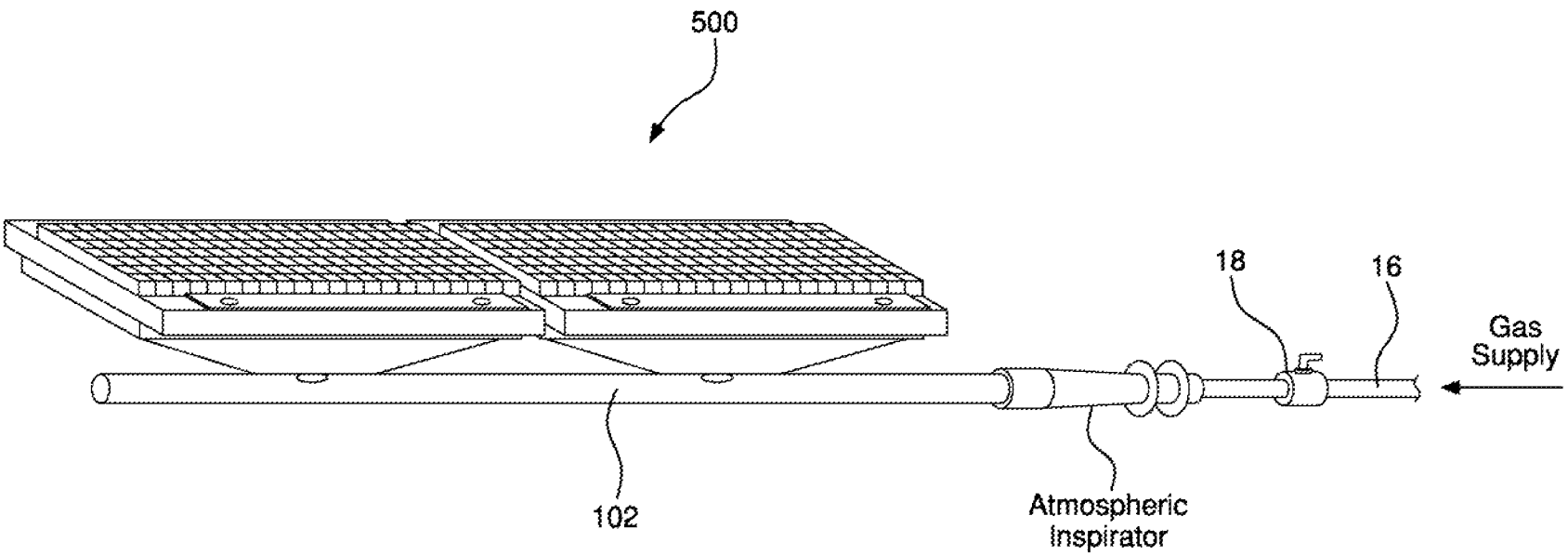
FIG. 13 (Prior Art)
FIG. 13 is a schematic view of a typical prior art atmospheric burner system.
Figure 14:
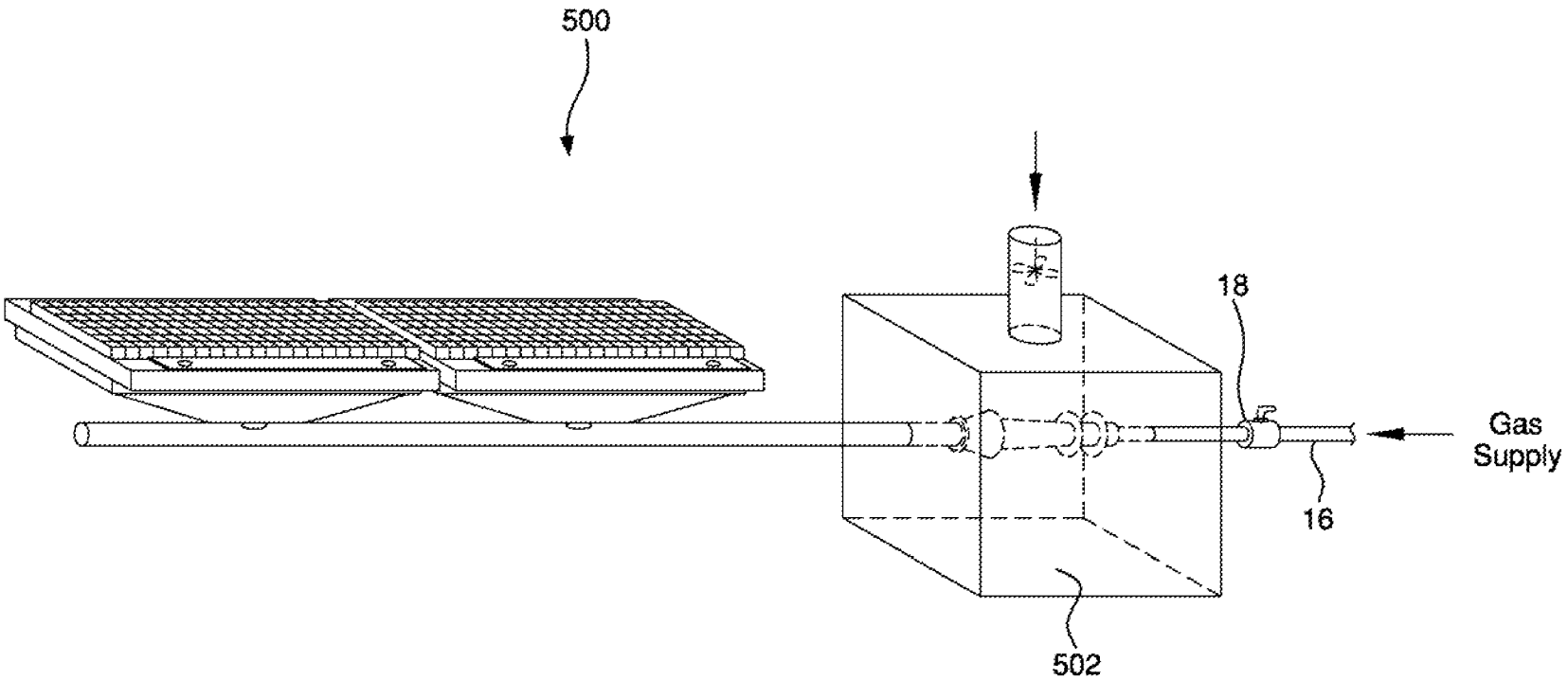
FIG. 14 (Prior Art)
FIG. 14 is a schematic view of a typical prior art positive pressure burner system.

Referring now to FIG. 13, another alternative to premix technology for operating a small burner or burner system 500 is called atmospheric, as it does not use a combustion air blower. It has lower output and is more difficult to control than a premix burner using a combustion air blower. An atmospheric system has a jet of gas directed into an atmospheric inspirator which draws surrounding air in to feed a burner. Some atmospheric burners are placed within positive pressure chambers 502 to help force more air into the inspirator, as seen in FIG. 14. This is still much less powerful than a premix system.

The following lists a typical IR system's auxiliary equipment required to be code compliant. A typical prior art system, such as those shown in FIGS. 11-12, requires a combustion air blower (1), combustion air filter (1), complete gas train including gas blocking valves (2), vent valve (1), high and low gas switches (2) gas ball valves (2), leak test ports (2), zero-gas regulator (one per mixer), combustion air pressure switch (1), manual butterfly valve (1 per mixer), motorized butterfly valve (1 per zone of control), aspirator mixer (1 per zone of control), flame safeguard control panel (one module per burner array), motor starter, electrical disconnect, ignition transformers (1 per burner array).

The premix static blower of the present invention eliminates the need for an aspirator mixer and a zero-gas regulator. The complete gas train with built in zero-gas regulator and two blocking valves (one piece construction), eliminates the need for two separate blocking valves, a separate vent valve, and a separate ball valve. Also, the speed regulating device for changing the blower's RPM value allows for different amounts of an air/gas mixture to be delivered to the burner array without changing the air/gas ratio. This eliminates the need for a motorized butterfly valve.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An operating and control package for a plurality of pressurized burners, the burners having a burner manifold, the operating and control package comprising:

a controller, the controller being an integrated packaged unit for supplying and controlling each of the pre-mixed air/gas pressurized burners;

a housing for containing the controller intended to be located at the end of the burner manifold;

a gas control device comprising a gas control valve for receiving gas entering the control package and a premix blower located within the housing for receiving gas from the gas control valve and air entering the control package, whereby the gas control device mixes the air and gas to form a pressurized combustible mixture which is fed into the burners:

separate ignition and ignition monitoring devices for each burner; and an air/gas control and safety system comprising a blower pressure monitor.

2. The operating and control package according to claim 1 further comprising: an air intake filter.

3. The operating and control package according to claim 2 wherein the air/gas control and safety system comprises a flame monitor.

4. The operating and control package according to claim 1 further comprising: indicator lights, and operating switches.

5. The operating and control package according to claim 1 further comprising: intake ports for the air and the fuel gas.

6. The operating and control package according to claim 1 further comprising: an adjustment control for use by a user for varying the air/gas input flow rate to the burners between a maximum and minimum output which may be pre-set to correspond to the specific burner requirements.

7. The operating and control package according to claim 1 further comprising: a bracket disposed around the inside or outside perimeter of the housing for mounting the device in various configurations.

8. The operating and control package according to claim 1 further comprising an alarm relay for notifying the user of failure conditions.

9. The operating and control package according to claim 1 wherein the burners are for an infrared process heating system, and further comprising a double blocking gas safety shut off valve, high gas and low gas safety switches, a negative air pressure switch for an input of the blower, and a pressure switch for an output of the blower.

10. An improved pressurized burner system comprising:

a plurality of pre-mixed air/gas pressurized burners and a burner manifold;

a controller, the controller being an integrated packaged unit for supplying and controlling the pre-mixed air/gas pressurized burners;

a housing for containing the controller located at the end of the burner manifold; and a gas control device comprising a gas control valve for receiving gas entering the control package and a premix blower located within the housing for receiving gas from the gas control valve and air entering the control package, whereby the gas control device mixes the air and gas to form a pressurized combustible mixture which is fed into the burners:

separate ignition and ignition monitoring devices for each burner; and an air/gas control and safety system comprising a blower pressure monitor.

11. The burner system according to claim 10 further comprising: and an air intake filter.

12. The burner system according to claim 11 wherein the air/gas control and safety system comprises a flame monitor.

13. The burner system according to claim 10 further comprising: indicator lights, and operating switches.

14. The burner system according to claim 10 further comprising: intake ports for the air and the fuel gas.

15. The burner system according to claim 10 further comprising: an adjustment control for use by a user for varying the air/gas input flow rate to the burners between a maximum and minimum output which may be pre-set to correspond to the specific burner requirements.

16. The burner system according to claim 10 further comprising: a bracket disposed around the inside or outside perimeter of the housing for mounting the device in various configurations.

17. The operating and control package according to claim 10 further comprising an alarm relay for notifying the user of failure conditions.

18. The burner system according to claim 10 wherein the burner system is for an infrared process heating system, and further comprising a double blocking gas safety shut off valve, high gas and low gas safety switches, a negative air pressure switch for an input of the blower, and a pressure switch for an output of the blower.

* * * * *